US005317843A

United States Patent [19]

Sheehan

[11] Patent Number: 5,317,843

[45] Date of Patent: Jun. 7, 1994

[54] GUTTERS

[76] Inventor: Naynor C. Sheehan, M.S. 499, Toowoomba, Queensland, 4350, Australia

[21] Appl. No.: 964,207

[22] Filed: Oct. 20, 1992

[30] Foreign Application Priority Data

Oct. 22, 1991 [AU] Australia ..... PK9026

[51] Int. Cl.[5] ..... E04D 13/06

[52] U.S. Cl. ..... 52/11; 248/48.2

[58] Field of Search ..... 248/48.2; 52/11

[56] References Cited

U.S. PATENT DOCUMENTS

| | | | |
|---|---|---|---|
| 3,420,378 | 1/1969 | Turner | 210/474 |
| 3,507,078 | 4/1970 | Sayers, Sr. | 52/15 |
| 4,019,290 | 5/1977 | Manty | 52/11 |
| 4,072,285 | 2/1978 | Greenwood | 248/48.2 |
| 4,309,792 | 1/1982 | Faye | 52/11 |
| 4,311,292 | 1/1982 | Deason | 52/11 |
| 4,669,232 | 6/1987 | Wyatt | 52/11 |
| 4,837,987 | 6/1989 | Fender | 52/11 |
| 5,146,718 | 9/1992 | Baskett | 52/11 |

*Primary Examiner*—James L. Ridgill, Jr.

*Attorney, Agent, or Firm*—Fay, Sharpe, Beall, Fagan, Minnich & McKee

[57] ABSTRACT

A pivotable gutter mount (14) which allows a rain gutter (10) to tilt or pivot, such that leaves, needles, dirt and other debris may be dumped out of the rain gutter (10). The gutter mount (14) comprises a generally L-shaped bracket portion (40) having a mounting leg (46) adapted for fixing to the fascia board (12) and a support leg (45) extending outwardly from the fascia board (12). A distal end of the support leg (45) is pivotally connected to a middle region of the underside of the gutter. As the pivotal connection is located under the centre of gravity, the gutter can be easily pivoted. The arrangement also affords greater flexibility in the placement of gutter mounts on the fascia board.

12 Claims, 5 Drawing Sheets

GUTTERS

The present invention relates to improvements to gutters. In particular, it is directed to a pivotable gutter mount which allows a rain gutter to tilt or pivot, such that leaves, needles, dirt and other debris may be dumped out of the rain gutter.

Gutter clips are commonly used to mount a rain gutter to a fascia trim board of a building. Generally, the clips comprise:

a fascia board mounting portion;

a first upper extension of the fascia board mounting portion being bent over to clamp the back wall of the gutter against the fascia board mounting portion;

a second upper extension of the fascia board mounting portion extending between the back wall and the front wall of the gutter to provide support for the front wall of the gutter; and a gutter supporting portion extending from the lower end of the fascia board mounting portion for supporting the bottom wall of the gutter.

These gutter clips do not allow a rain gutter to tilt such that leaves and debris may be dumped out of the gutter. Known gutter brackets for allowing a rain gutter to pivot possess other disadvantages which will become apparent from the following discussion.

U.S. Pat. No. 4669232 discloses a gutter bracket adapted to be secured to a fascia trim board of a building. The bracket has a hinge adapted for securement to a lower inside corner of a rain gutter. Due to the positioning of the hinge on the gutter, the bracket must be secured to the fascia board such that the hinge is always adjacent to the lower edge of the fascia board in order to permit the gutter to pivot through a sufficient angle to discharge all the debris therein. Depending on the height of the fascia board, this may result in the gutter being located an impractical distance from the edge of the roof. Further, with the hinge always adjacent the lower edge of the fascia board, the gutter cannot be installed with adequate gradient to allow the water to drain out. A further disadvantage of this gutter bracket is the spring holding clip which extends across the top of the gutter. The presence of the clip prevents the gutter from covering the edge of the roofing material and thus results in an unsightly appearance. This clip is also dependent on the shape of the gutter for its function.

U.S. Pat. No. 4311292 discloses an L-shaped gutter bracket having a fascia mounting leg and a gutter supporting leg. The end of the gutter supporting leg remote from the fascia mounting leg is hinged to the front wall of a gutter. As the gutter supporting leg extends across the entire width of the gutter, and in the absence of a gutter strengthener spanning the top of the gutter, the gutter supporting leg must support the entire weight of the gutter and contents. The gutter supporting leg is therefore susceptible to quite appreciable deflection which would give the gutter an unsightly appearance.

Secondly, to tilt the gutter, it is necessary to pull the front wall down with sufficient force to lift the centre of gravity of the gutter over the pivot axis. Such force may disturb the gutter wall.

Thirdly, in this arrangement, the location of the gutter bracket with respect to the fascia board is also critical. If the gutter bracket is positioned too closely to the edge of the roof then the edge of the roof will obstruct the tilting of the gutter.

Fourthly, this bracket allows a space between the back wall of the gutter and the fascia mounting leg. Consequently a greater roof overhang is required, and the space may provide a harbour for vermin.

In a further pivotable arrangement, disclosed in U.S. Pat. No. 4019290, a gutter is pivotally mounted to the fascia board of a building and a rod is pivotally secured to the top edge of the front wall of the gutter. The rod is adapted to hold the gutter in an upright rain collecting position and/or to hold the gutter in an inverted position under the eaves of the building.

This arrangement also has several disadvantages. First, the provision of brackets and hinges under the eaves of the roof is unsightly. Secondly, such brackets and hinges are more likely to retain moisture and rust. Thirdly, multiple hinges are attached to the gutter at each support/rod location. Finally, the rods depending from the gutters would be aesthetically unpleasant, and could be the cause of accidents if an unsuspecting victim pulls a rod from the holding position and has the contents of the gutter dumped onto him/her.

It is an object of the present invention to provide a gutter bracket and guttering system which substantially overcome or ameliorate the abovementioned disadvantages or at least provide the public with a useful choice.

In one broad form, the present invention provides a pivotable gutter mount for pivotally mounting a gutter to the fascia board of a building, wherein the gutter is in the form of a trough having a front wall, a back wall and a bottom wall extending therebetween, the gutter mount comprising a generally L-shaped bracket portion having a mounting leg adapted for fixing to the fascia board and a support leg extending outwardly from the fascia, the distal end of the support leg being pivotally connected to a middle region of the underside of the gutter.

Preferably, the gutter pivots about a longitudinal axis coincident with the longitudinal centreline of the bottom wall of the gutter.

The mounting leg may be attached to the fascia board by any suitable fastening means. Preferably, the mounting leg is adapted to extend upwardly along the fascia board. It is also preferred that the mounting leg may be of a length corresponding to the length of the back wall of the gutter which is to be mounted by the gutter mount. The L-shaped support may be constructed of sheet metal.

Preferably, the support leg is constructed of a material of sufficient strength to carry the weight of the gutter and contents.

The distal end of the support leg may be pivotally connected to a gutter clip portion which is adapted to be secured to the gutter. The clip portion may include a generally L-shaped portion comprising:

a back wall contacting portion, adapted to contract the back wall of the gutter in use; and a gutter supporting portion extending from the bottom end of the back wall contacting portion for supporting the bottom wall of the gutter. The gutter supporting portion may extend to the middle region of the underside of the gutter, there being pivotally connected to the support leg of the bracket portion. Alternatively the gutter supporting portion may extend across the entire width of the bottom wall of the gutter, but pivotally connected at its middle to the end of the support leg of the gutter mount.

The clip portion may be further provided with a gutter strengthening portion extending from the top end of the back wall contacting portion to the front wall of the gutter to provide support for the front wall. The gutter strengthening portion may comprise an elongate strip. The strip may be curved or bent as is known in the art. The gutter strengthening portion may be extendable in length to accommodate a variety of gutter sizes and shapes. Preferably, the gutter strengthening portion comprises two elongate strips which may be connected together at a variety of locations to achieve a variety of overall lengths.

In one form of the invention, the clip portion may comprise a continuous band encircling the gutter.

The pivotal connection may comprise a hinged connection. The hinged connection may comprise a separable hinge attached to the distal end of the support leg. Alternatively, the hinged connection may comprise a hinge pin inserted through axially aligned tubular formations on the support leg of the bracket portion and the clip portion. In one preferred form, the gutter supporting portion of the clip portion passes through a slot which extends across the support leg such that the gutter supporting portion may pivot with respect to the support leg.

The distal end of the mounting leg remote from the support leg may have a clip formation to releasably retain the gutter in its upright orientation. The clip formation may comprise a resilient clip. Preferably, the resilient clip is an integrally formed extension of the distal end of the mounting leg. Preferably, in use, the resilient clip co-acts with the gutter strengthening portion of the clip portion to hold the gutter in an upright orientation.

The clip portion may be further provided with a clamping portion comprising a second elongate strip extending from the top end of the back wall contacting portion and designed to be bent over to retain the back wall of the gutter against the back wall contacting portion.

In accordance with a second aspect of the present invention, there is disclosed a guttering system comprising a first gutter portion pivotally mounted to a fascia board of a building by one or more pivotable gutter mounts as defined in accordance with the first aspect of the invention such that the first gutter portion may be pivoted to a position whereby debris in the gutter can fall out of the gutter, and a second gutter portion contiguous with said first gutter portion and mounted in fixed relation to the fascia board of the building.

The second gutter portion may be mounted to the fascia board by conventional gutter clips as hereinbefore defined. Preferably, the second gutter portion is short in length compared to the first gutter portion.

The second gutter portion is fixed to the fascia to accommodate a downpipe or a corner portion of the guttering, either an internal or external corner.

In accordance with a third aspect of the present invention, there is disclosed a guttering system comprising a gutter pivotally mounted to a fascia board of a building by on or more pivotable gutter mounts as defined in accordance with the first aspect of the invention such that the gutter may be pivoted to an inverted position whereby debris in the gutter may be dumped out of the gutter, the gutter having a drain hole in the bottom wall thereof, and said guttering system further comprising a downpipe having an open upper end located directly beneath the drain hole but spaced from the gutter such that the gutter clears the downpipe in the inverted position.

The upper end of the downpipe may be provided with a funnel member to aid in water collection. Alternatively, an intermediate drainpipe portion may extend between the drain hole and the upper end of the downpipe, the intermediate portion being removable to allow the gutter to pivot to the inverted position.

In accordance with the a fourth aspect of the present invention, there is disclosed a guttering system comprising a gutter pivotally mounted to a fascia board of a building by one or more pivotable gutter mounts as defined in accordance with the first aspect of the invention, such that the gutter ma be pivoted to an inverted position whereby debris in the gutter may be dumped out of the gutter, the gutter having a drain hole in the bottom wall thereof, said gutter system further provided with an upper drainpipe portion and a lower drainpipe portion wherein said upper drainpipe portion is pivotally mounted to the lower drainpipe portion such that in normal use the upper drainpipe portion is in fluid communication with the drain hole but during cleaning of the gutter, the upper drainpipe portion is pivotable to a position whereby the gutter clears the upper drainpipe portion in the inverted position.

In use, the gutter bracket may be pivoted to its inverted position by a user on the ground with the aid of a handheld tool in the form of a rod having a gutter gripping portion at one end thereof.

In accordance with a last aspect of the present invention, there is disclosed a guttering system comprising a first gutter portion pivotally mounted to a fascia board of a building by one or more pivotable gutter mounts as defined in accordance with the first aspect of the present invention such that the first gutter portion may be pivoted to a position whereby debris in the gutter can fall out of the gutter, a second gutter portion mounted to the fascia board of the building and a sealing means between the first gutter portion and the second gutter portion wherein the transverse edges of the first and second gutter portions are provided with shoulder portions such that the first and second gutter portions may interlock and overlap at overlapping zones along the transverse edges of the first and second gutter portions.

Preferably, the overlapping zone of the first gutter portion along the edge of the back wall and the back half of the bottom wall overlaps the corresponding zone of the second gutter portion, and the overlapping zone of the second gutter portion along the front wall and the front portion of the bottom wall overlaps the corresponding zone of the first gutter portion. Sealing material such as expanded rubber may be located between the corresponding overlapping zones. A bracket may also be provided to support the gutter portions in the region of the sealing means. The second gutter portion may be pivotally mounted to the fascia board or mounted in fixed relation thereto.

In order that the invention may be more fully understood and put into practice, one embodiment of the invention will no be described by way of example with reference to the drawings in which.

Figure 1:
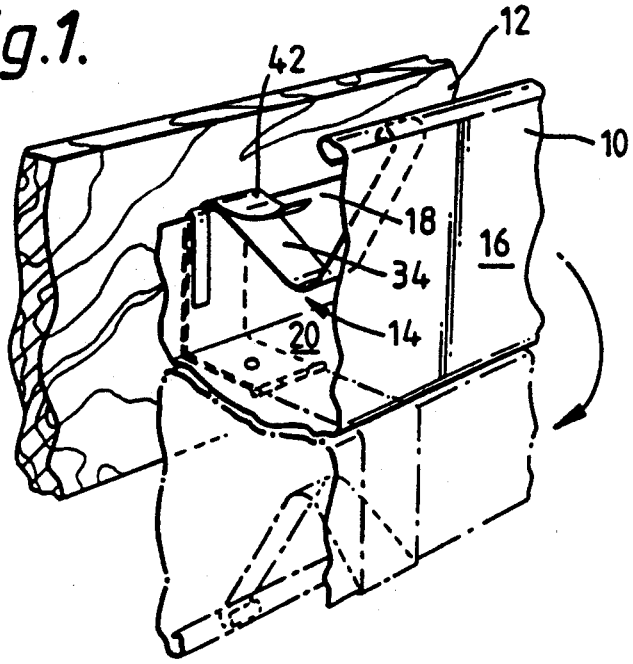
FIG. 1 is a perspective view of a pivotable gutter mount in accordance with a first embodiment of the present invention.

FIG. 1 illustrates a gutter 10 mounted to a fascia board 12 of a building (not shown) by a plurality of pivotable gutter mounts, only one gutter mount 14 being shown for clarity. The gutter 10 is in the form of a trough having a front wall 16, a back wall 18 and a bottom wall 20 extending therebetween. The gutter 10 is shown in bold outline in the upright, rainwater collecting position, and in broken outline in the inverted position whereby debris may be discharged from the gutter 10.

Figure 3:
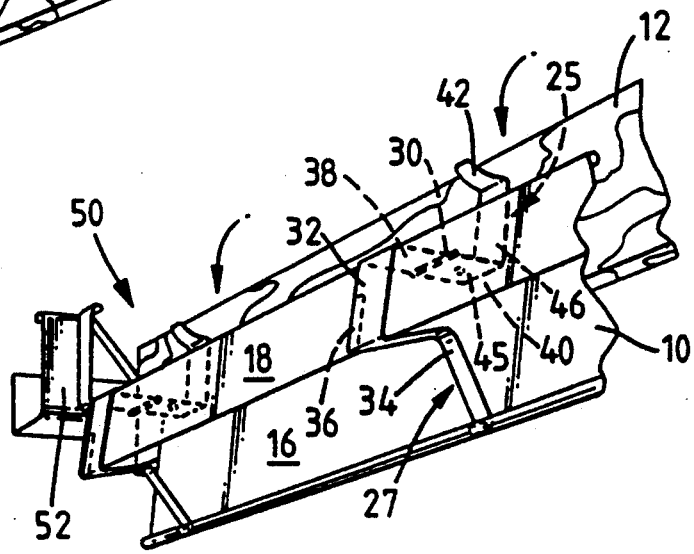
FIG. 3 is a perspective view of the guttering system of FIG. 2 illustrating the pivotable gutter portion in the inverted position.

As FIG. 3 more clearly shows, the gutter mount 14 comprises a bracket portion 25 and a gutter clip portion 27 pivotally joined by hinge 30. The gutter clip portion 27 is a continuous strip of sheet metal comprising a back wall contacting portion 32, a gutter strengthening portion 34 to provide support for the front wall 16 of the gutter 10, a clamping portion 36 to retain the back wall 18 of the gutter against the back wall contacting portion 32 and a gutter supporting portion 38 for supporting the bottom wall 20 of the gutter 10.

The back wall contacting portion 32 extends along the entire height of the back wall 18 of the gutter 10. The gutter strengthening portion 34 extends from one (upper) end of the back wall contacting portion 32 to the front wall 16 of the gutter 10, and is bent for added strength as is known in the art. The clamping portion 36 also extends from the same upper end of the back wall contacting portion 32 and, in use, is bent over to retain the back wall 18 of the gutter 10 against the back wall contacting portion 32. The gutter supporting portion 38 extends from the other (lower) end of the back wall contacting portion 32. The length of the gutter supporting portion 38 is such that the hinge 30 is located generally centrally of the bottom wall 20 of the gutter 10.

The bracket portion 25, which is also a continuous strip of sheet metal, comprises an L-shaped bracket 40 and a resilient clip 42. The L-shaped bracket 40 has a support leg 45 and a mounting leg 46. The end of the support leg 45 remote from the mounting leg 46 is connected to the hinge 30. The hinge may be formed by inserting a hinge pin through axially aligned hinge formations formed on the ends of the support leg 45 and gutter supporting portion 38.

The mounting leg 46 may be secured to the fascia board 12 by any suitable fasteners. The dimensions of the supporting leg 45 and the mounting leg 46 are such that when the gutter 10 is in the upright position, the gutter supporting portion 38 is seated against the supporting leg 45, and the back wall contacting portion 36 is seated against mounting leg 46 as shown in FIG. 1.

FIG. 1 also illustrates the resilient clip 42 which extends from the end of the mounting leg 46 remote from the support leg 45. The clip 42 is biased against the gutter strengthening portion 34 to hold the gutter 10 in the upright position.

Figure 2:
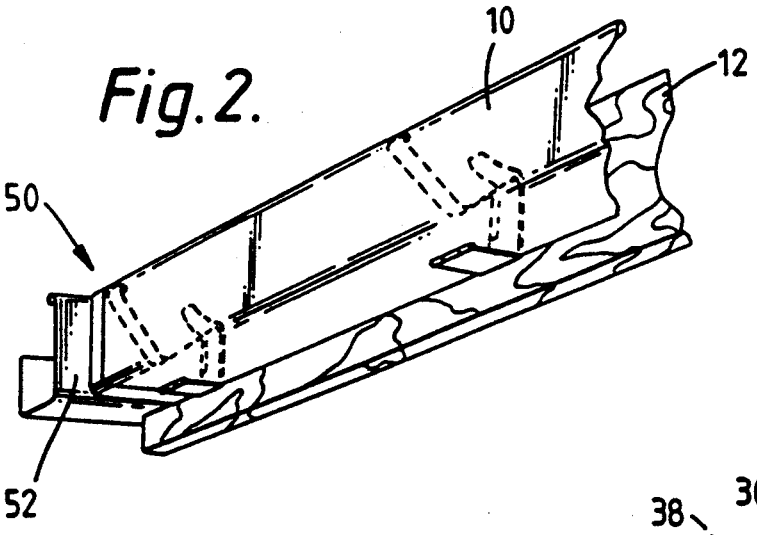
FIG. 2 is a perspective view of a guttering system with a pivotable gutter portion in the upright position.

FIGS. 2 and 3 illustrate a two-part guttering system 50 which accommodates a corner of the building, in this case, an internal corner. The guttering system 50 comprises a first gutter portion 10 pivotally mounted to a fascia board 12 of a building utilising gutter mounts 14 or 80 as hereinbefore described. The gutter system 50 further comprises a second gutter portion 52 contiguous with the first gutter portion 10 but mounted in fixed relation to the fascia board 12 of a building. A sealing arrangement may suitably be provided between the abutting ends of the gutter portions 10, 52. As shown in FIG. 3, the portion 10 may pivot while the portion 52 remains fixed to the fascia.

Figure 4:
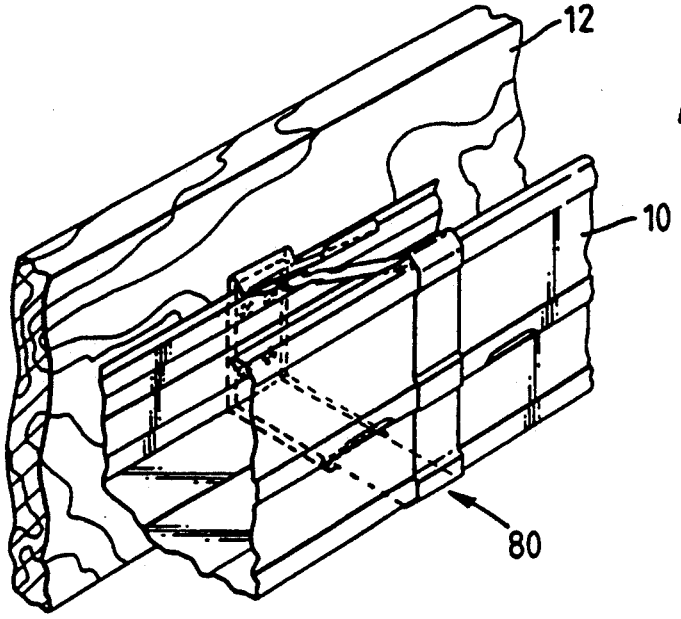
FIG. 4 is a perspective view of a pivotable gutter mount and gutter in accordance with a second embodiment of the present invention.
Figure 5:
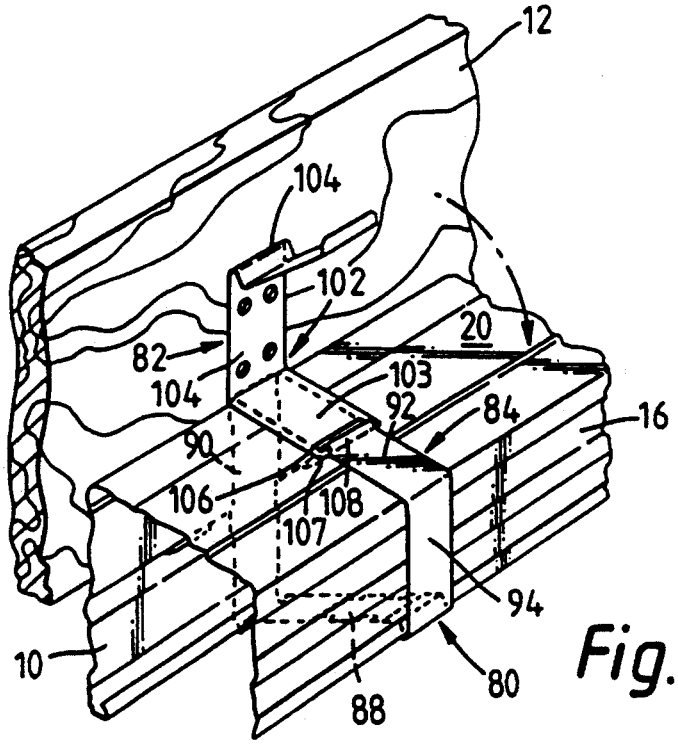
FIG. 5 is a perspective view of a pivotable gutter mount and gutter of FIG. 4 showing the gutter in the inverted position.

FIGS. 4 and 5 illustrate a gutter 10 mounted to a fascia board 12 utilising the pivotable gutter mount 80 in accordance with the second preferred embodiment of the invention. In FIG. 4 the gutter 10 is in the upright, rainwater collecting position and in FIG. 5, the gutter 10 is shown in the inverted position whereby debris may be discharged from the gutter 10.

As FIG. 5 more clearly shows, the gutter mount 80 comprises bracket portion 82 and gutter clip portion 84 pivotally joined by a hinge 86. The gutter clip portion 84 is a band of sheet metal encircling the gutter and joined at junction 88 by any suitable means. The band includes back wall contacting portion 90, gutter supporting portion 92, extending across the width of the bottom wall 20 of the gutter 10, front wall contact portion 94 and gutter strengthening portion 96 to provide support for the front wall 16 of the gutter 10. The gutter strengthening portion is bent adjacent the front wall 16 and the rear wall 18 of the gutter 10 to retain the gutter clip portion 84 in position and to provide clearance for the edge of the roof so that the gutter 10 may be installed close to the edge of the roof.

The bracket portion 82 which is also a continuous strip of sheet metal, comprises an L-shaped bracket 102 and resilient clip 103 similar to clip 42 of the first preferred gutter mount.

The L-shaped bracket 102 has a support leg 103 and a mounting leg 104. The end of the support leg 103 remote from the mounting leg is provided with a crosswise slot 106 through which the gutter supporting portion 92 passes. A hinge pin portion 107 is therefore formed in the end of the support leg 103 and is retained between the bottom wall of the gutter and a groove 10 in the gutter supporting portion 92. Therefore the gutter supporting portion 92 is rotatable about pin portion 107.

The mounting leg 104 may be secured to the fascia 12 by any suitable fasteners.

Figure 6:
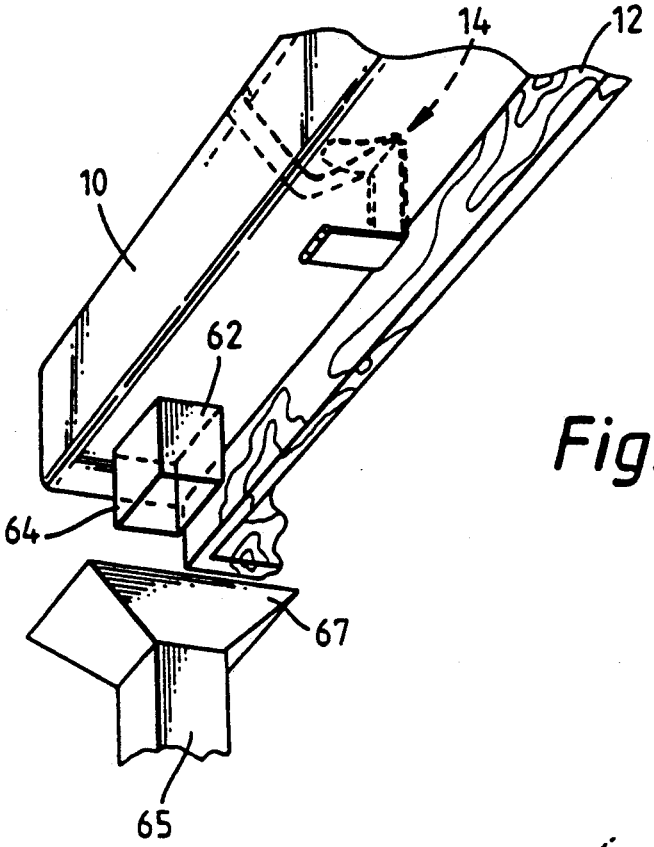
FIG. 6 is a perspective view of a first preferred gutter/downpipe system.

FIG. 6 illustrates a first preferred gutter/downpipe system 60. The gutter system has a gutter 10 pivotally mounted to the fascia board 12 of a building utilising gutter mounts 14 or 80 as hereinbefore described. A drain hole 62 is provided in the bottom wall 20 of the gutter 10 from which a chute 64 depends. The guttering system 60 also comprises a downpipe 65 the upper end of which is spaced from the lower end of the chute 64 such that the gutter 10 clears the downpipe in the inverted position. In use, water from the gutter 10 flows through the chute 64 and into the downpipe 65. A funnel 67 is provided on the upper end of the downpipe to aid in water collection.

Figure 7:
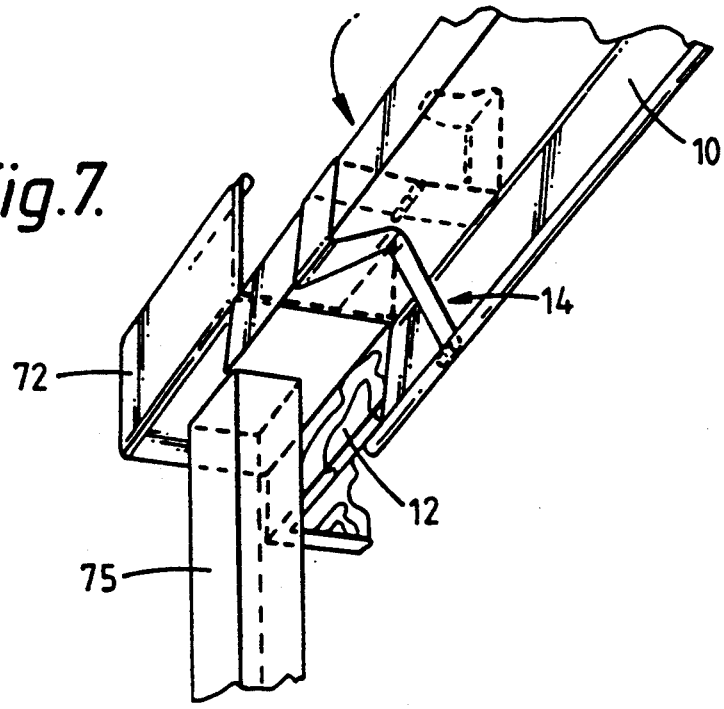
FIG. 7 is a perspective view of a second preferred gutter/downpipe system.

An alternative guttering/downpipe system 70 (FIG. 7) comprises a first pivotally mounted gutter portion 10 and a second gutter portion 72 mounted in fixed relation to the fascia board 12 of a building. The first gutter portion 10 is pivotally mounted using the gutter mounts 14 or 80 as hereinbefore described. The second gutter portion 72 is contiguous with the first gutter portion 10 in the upright position. The second gutter portion 72 has a downpipe 75 depending therefrom in the conventional manner.

Figure 8:
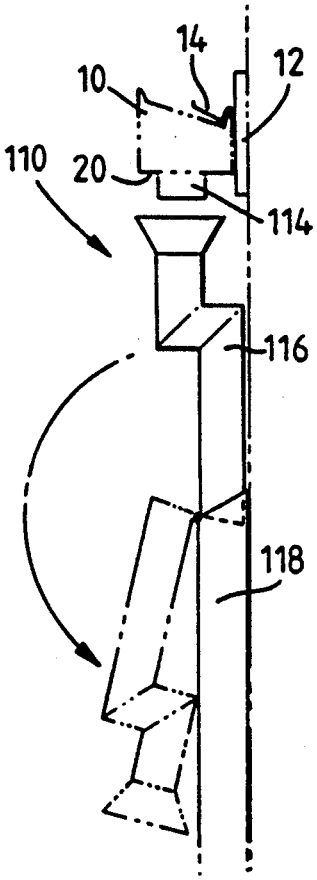
FIG. 8 is a perspective view of a third preferred gutter/downpipe system.

A third preferred gutter/downpipe system 110 is disclosed in FIG. 8 comprising a gutter 10 pivotally mounted to fascia board 12 using gutter mounts 14 or 80 as hereinbefore described. A chute 114 and drainhole are provided in the bottom wall 20 of the gutter 10. The guttering system also comprises an upper downpipe portion 116 hingedly connected to a lower downpipe portion 118. In normal use, the upper drainpipe portion 116 may be in an upright orientation as shown in bold outline to receive water from the chute 114. When it is desired to clear debris from the gutter 10, the upper drainpipe portion 116 may swing down to a position shown in phantom whereby the gutter 10 clears the upper drainpipe portion 115 in the inverted position.

Figure 9:
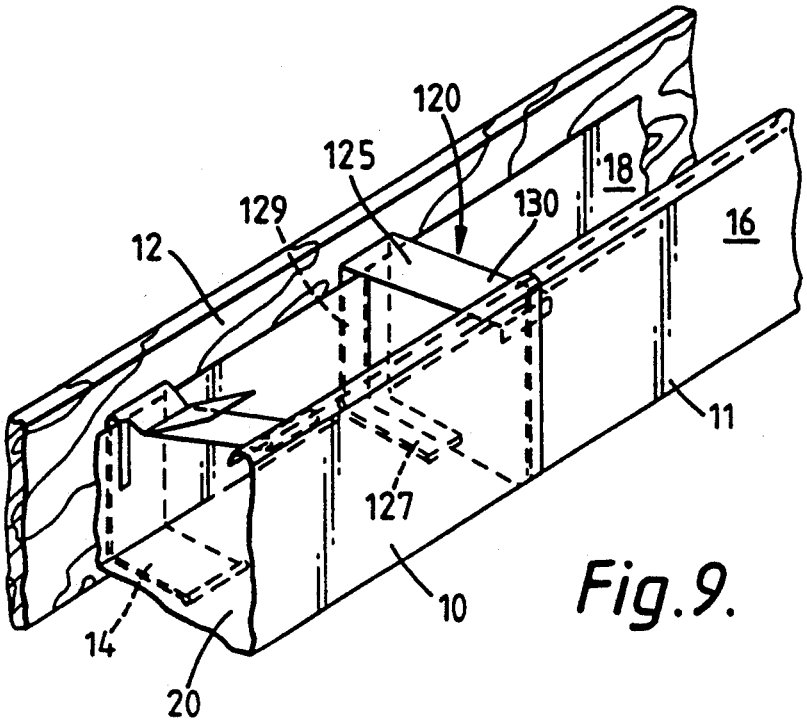
FIG. 9 is a perspective view of a sealing means between adjacent gutter portions that may be used in a gutter system incorporating the gutter mounts of FIGS. 1 to 3 or as modified by FIGS. 4 and 5. The sealing means may also be used in any of the gutter/downpipe systems of FIGS. 6 to 8.
Figure 10:
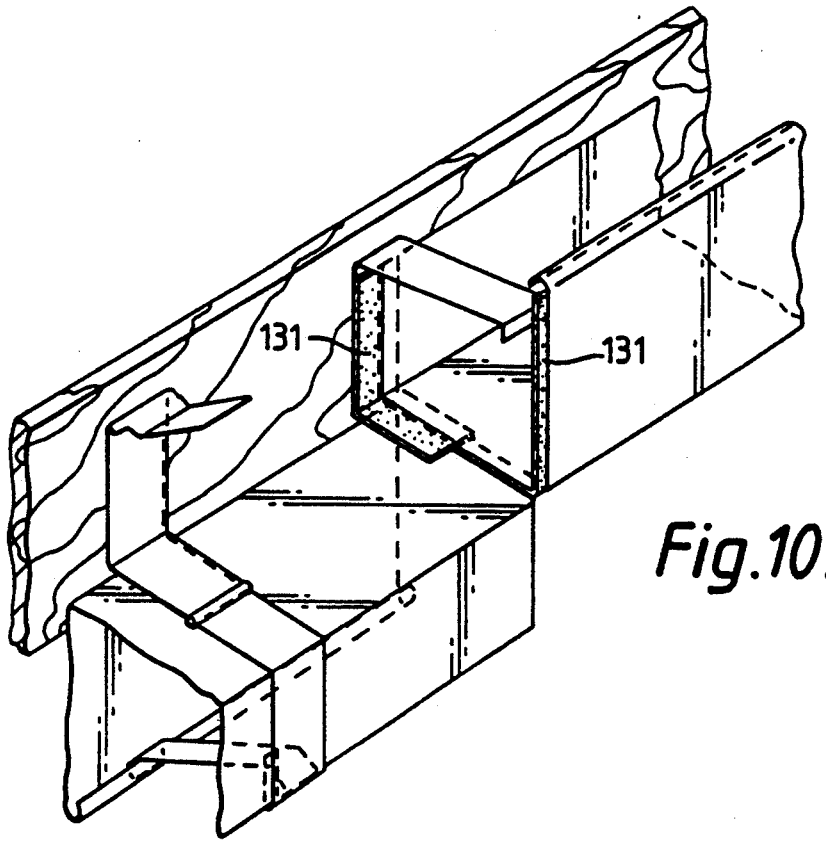
FIG. 10 is a perspective view of the sealing means of FIG. 9 showing one pivotable gutter portion in the inverted position.

FIGS. 9 and 10 illustrate a preferred sealing means 120 between adjacent gutter portions 10 and 11. Gutter portion 10 is pivotally mounted to the fascia board 12 by the pivotable gutter mount 14 as hereinbefore described. Gutter portion 11 may be fixed with respect to the fascia board 12 or alternatively it may be pivotally mounted in a similar fashion to gutter portion 10. Gutter portions 10 and 11 have overlapping regions such that the back wall 18 and the back half of the bottom wall 20 of the gutter portion 10 are inside of the corresponding parts of the gutter portion 11. Similarly, the front wall and the front half of the bottom wall 20 of the gutter portion 11 are inside of the corresponding parts of gutter portion 10.

The sealing means 120 includes a C-bracket 125 comprising a support arm 127 extending to the centre of the bottom walls 20 of portions 10 and 11, a mounting arm 129 for mounting the C-bracket to the fascia board 12 and a top arm 130 extending from the end of the mounting arm 129 remote from the support arm 127. The front wall 16 of portions 10 and 11 abut against the free end of top arm 130. The sealing means also includes sealing material 131 (see FIG. 10) extending along the inside of back wall 18 and the back half of bottom wall 20 of the gutter portion 11 and also along the inside of front wall 16 and the front half of bottom wall 20 of gutter portion 10. Preferably the sealing material comprises adhesive-backed foam rubber.

Figure 11:
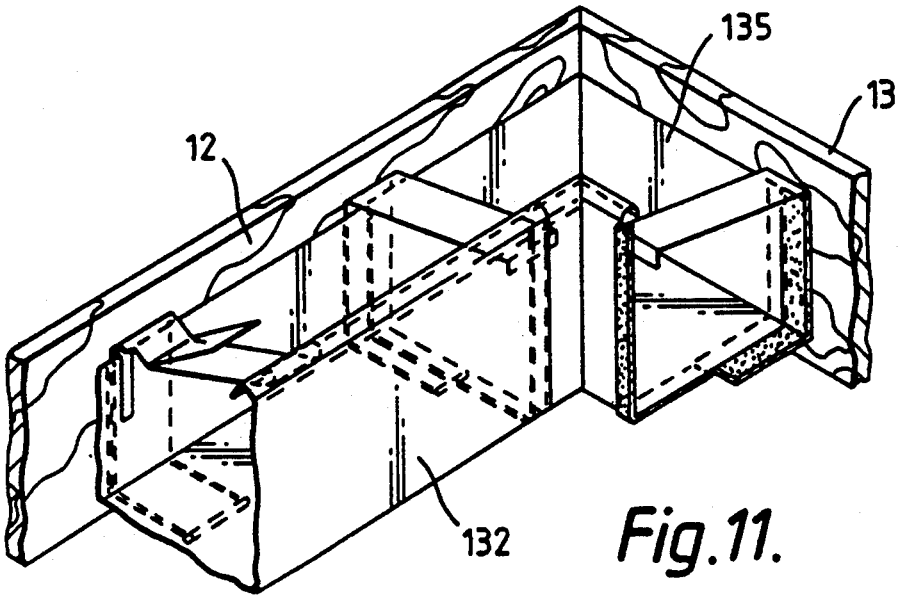
FIG. 11 is a perspective view of an internal corner of a gutter system utilising the sealing means of FIG. 9.
Figure 12:
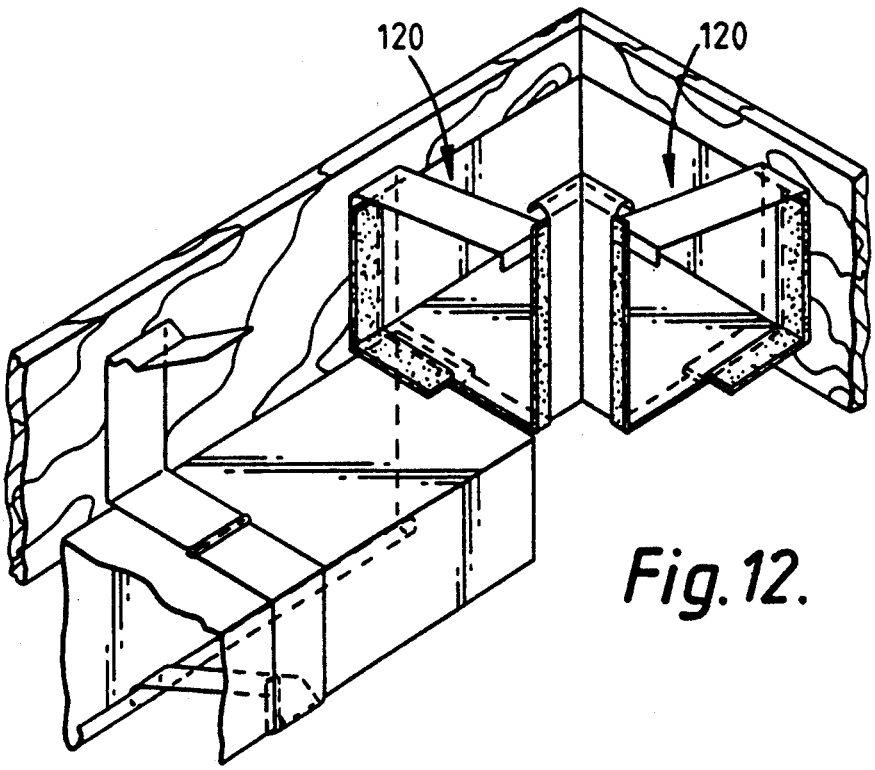
FIG. 12 is a perspective view of the internal corner of FIG. 11 showing one pivotable gutter portion in the inverted position.

In FIGS. 11 and 12, guttering for an internal corner comprises a first pivotable gutter portion 132 and a second pivotable gutter portion (not shown) pivotally mounted at right angles to each other along fascia board portions 12 and 13. First and second gutter portions are each formed to a corner gutter portion 135 utilising the sealing means 120 as described above.

The present invention has a number of advantages over previous methods of providing a pivoting gutter. The gutter mount is dual purpose in that it serves to mount the gutter to the fascia board as well as providing for pivoting movement of the gutter. The gutter mount supports the walls of the gutter to prevent buckling or twisting of the gutter under the weight of the water. In particular, the gutter mount of the second preferred embodiment directly supports all the walls of the gutter. As the pivotal connection is located under the centre of gravity, the gutter can be easily pivoted. The central location of the pivotal connection also minimises the required clearance between the gutter and the edge of the roof when the gutter is being pivoted. The gutter mounts may therefore be positioned in a wide range of positions on the fascia board. This greater flexibility in the placement of the gutter mounts allows the gutter to be installed on the fascia board with an adequate gradient to allow the water to drain out. Further, the location of the pivot point allows adjacent gutter portions to be joined by overlapping the ends of the adjacent gutter portions such that half the bottom wall and one of the front or rear walls of each end form the inside of the gutter. This arrangement enables the guttering system to negotiate corners, long lengths of guttering may be broken up into smaller lengths and the pivotable portions need only be installed in problem areas of the guttering system.

The foregoing describes only some embodiments of the invention, and modifications which are obvious to those skilled in the art may be made thereto without departing from the scope of the invention as defined in the following claims.

I claim:

1. A rain gutter system comprising: a gutter in the form of a trough having a front wall, a back wall and a bottom wall extending therebetween; a gutter mount comprising a generally L-shaped bracket portion having a mounting leg adapted for fixing to a fascia board of a building, and a support leg which, in use, extends outwardly from the fascia; a distal end of the support leg being pivotally connected to a center portion of the bottom wall of the gutter, the gutter being invertible by pivoting relative to the gutter mount to dump out debris collected therein.

2. A rain gutter system as claimed in claim 1 wherein the pivotal connection comprises a hinged connection.

3. A rain gutter system as claimed in claim 1 further comprising a drain hole in the bottom wall, and a downpipe having an open upper end located directly beneath the drain hole but spaced from the gutter such that the gutter clears the downpipe when inverted.

4. A rain gutter system as claimed in claim 1 further comprising a drain hole in the bottom wall, an upper drainpipe portion and a lower drainpipe portion, the upper drainpipe portion being pivotally mounted to the lower drainpipe portion such that in normal use the upper drainpipe portion is in communication with the drain hole but is pivotable to a position whereby the gutter clears the upper drainpipe portion when inverted.

5. A rain gutter system as claimed in claim 1 further comprising a second gutter fixedly mounted to the fascia board of the building and forming a continuation of the first gutter, the first and second gutters having adjacent overlapping edges.

6. A rain gutter system as claimed in claim 1 further comprising a gutter clip portion secured to the gutter, wherein the distal end of the support leg is pivotally connected to said gutter clip portion.

7. A rain gutter system as claimed in claim 6 wherein the clip portion includes a generally L-shaped portion comprising:

a back wall portion juxtaposed with the back wall of the gutter ; and a gutter support portion extending from a lower end of the back wall portion for supporting the bottom wall of the gutter.

8. A rain gutter system as claimed in claim 7 wherein the clip portion further includes a gutter strengthening portion extending from a top end of the back wall portion to the front wall of the gutter to provide support for the front wall.

9. A rain gutter system as claimed in claim 7 wherein a top end of the mounting leg has a clip formation to releasably retain the gutter in its upright orientation.

10. A rain gutter system as claimed in claim 7 wherein the clip portion further includes an elongate strip extending from a top end of the back wall portion and bent downwardly to retain the back wall of the gutter in juxtaposition with the back wall portion.

11. A rain gutter system as claimed in claim 6 wherein the clip portion comprises a continuous band encircling the gutter.

12. A rain gutter system as claimed in claim 11 wherein the band passes through a transverse slot in the support leg such that the band and gutter are pivotable with respect to the support leg.

* * * * *